US005860822A

United States Patent [19]

Nishide et al.

[11] Patent Number: 5,860,822

[45] Date of Patent: Jan. 19, 1999

[54] CONNECTOR WITH WATERPROOFING FEATURES

[75] Inventors: Satoru Nishide; Hajime Kawase, both of Yokkaichi; Takahiro Yoneda; Takafumi Kishi, both of Yokohama, all of Japan

[73] Assignee: Sumitomo Wiring Systems, Ltd., Japan

[21] Appl. No.: 799,027

[22] Filed: Feb. 10, 1997

[30] Foreign Application Priority Data

| | | | |
|---|---|---|---|
| Feb. 9, 1996 | [JP] | Japan | 8-023824 |
| Feb. 20, 1996 | [JP] | Japan | 8-031984 |
| Feb. 20, 1996 | [JP] | Japan | 8-031985 |

[51] Int. Cl.[6] ..... H01R 13/436

[52] U.S. Cl. ..... 439/206; 439/281; 439/752; 439/354

[58] Field of Search ..... 439/205, 206, 439/732, 752, 595, 587, 589, 281, 354

[56] References Cited

U.S. PATENT DOCUMENTS

| | | | |
|---|---|---|---|
| H280 | 6/1987 | Thigpen | 439/206 |
| 2,945,203 | 7/1960 | Quackenbush | 439/453 |
| 3,994,553 | 11/1976 | Kornick | 439/281 |
| 4,806,123 | 2/1989 | Konishi | 439/595 |
| 4,986,758 | 1/1991 | Wakata | 439/595 |
| 5,066,252 | 11/1991 | Kato et al. | 439/752 |
| 5,299,958 | 4/1994 | Ohsumi | 439/752 |
| 5,509,829 | 4/1996 | Saba | 439/752 |
| 5,562,500 | 10/1996 | Tsukakoshi | 439/752 |

FOREIGN PATENT DOCUMENTS

| | | | |
|---|---|---|---|
| 446178 | 6/1927 | Germany | 439/732 |
| A 3-29276 | 2/1991 | Japan . | |
| 3-744482 | 7/1991 | Japan | 439/587 |
| 2198596 | 6/1988 | United Kingdom | 439/206 |

*Primary Examiner*—Neil Abrams
*Attorney, Agent, or Firm*—Banner & Witcoff, Ltd.

[57] ABSTRACT

An electrical connector has male and female housings 10, 30 having terminal retainers 20, 40 and retainer insertion holes 16, 36. To prevent creep of moisture by surface tension effects through the clearance between the terminal retainers 20, 40 and the retainer fitting holes 16, 36, the retainer is formed with a C-shaped recess 23, 43, and the retainer and hole are formed with matching cranked portions 19, 24, 39, 44. A central drain channel 15, 35 runs through the center of each housing 10, 30 and is sealed by means of mutually fitting tapered faces 26A, 46A. Overhanging hoods 14*a*, 14*d* shield the mating faces and rear ends of the connector housings. Mating terminal chambers 11, 31 also have tapered sealing faces 28, 48. A peripheral rib 45 on one housing 30 fits into a groove 25 on the housing with a long narrow clearance to prevent moisture creep. Drain channels 15, 35 engage one another at tapered mating faces 26A, 36A. The terminal retainer 20, 40 moisture creep prevention features are designed to direct the moisture into the drain channels 15, 35. A rear hood is also used to shield the open rear ends of the terminal apertures.

25 Claims, 6 Drawing Sheets

CONNECTOR WITH WATERPROOFING FEATURES

TECHNICAL FIELD

The present invention relates to a connector provided with a retainer, and in particular relates to an electrical connector wherein simplified water-proofing arrangements are provided.

BACKGROUND TO THE INVENTION

In electrical connectors which have removable or mating parts it is difficult to eliminate the necessary assembly clearance to an extent sufficient to prevent moisture migrating into the clearance due to surface tension or capillary effects. Separate flexible seals may be required, and these can increase costs significantly. A reduction of the clearance makes assembly more difficult, and may in any event lead to passage of moisture due to capillary effects.

Among connectors are those, as described for example in JP-A-3-29276, wherein a retainer is used as a means for preventing removal of a terminal fitting housed in a terminal fitting housing chamber. Such a connector has a configuration whereby in its connector housing a retainer insertion hole is formed so as to open out to an outer face thereof, a retainer being attached by being inserted into the retainer insertion hole to retain a terminal fitting.

In the connector described above, since the configuration is such that the retainer insertion hole opens out to the outer face of the connector housing, a small space inevitably occurs between the retainer insertion hole and the retainer. If moisture passes into this space, it tends to be sucked in due to surface tension effects. As a result, this kind of connector is unsuitable in an environment where water is present. Other connectors are used in which a water-proofing means, such as a seal member or the like, is employed, but although such a connector has a high degree of water-proofing, the cost is also substantially increased.

Similar clearances may exist around the periphery of mating connectors, for example in the region of an overlapping hood, and also between mating internal faces of connector housings.

The present invention has been developed after taking these problems into account and aims to prevent movement of moisture in the clearance spaces formed between removable or mating parts of an electrical connector, while maintaining low cost.

SUMMARY OF THE INVENTION

According to a first aspect of the invention there is provided an electrical connector comprising a housing having a terminal aperture and a retainer aperture connecting therewith, the terminal aperture receiving in use an electrical terminal and the housing further comprising a retainer insertable in the retainer aperture to retain an electrical terminal in the housing, the retainer having a small peripheral clearance in the retainer aperture sufficient to form a transfer passage for moisture by surface tension effects, one of said retainer and retainer aperture including integral moisture stopping structure in said passage for substantially preventing transfer of water inwardly thereof.

A separate flexible seal is thereby avoided, and thus the cost of the connector can be kept low whilst providing an effective barrier to moisture ingress. In a preferred embodiment the housing and retainer comprise one piece plastics mouldings.

Preferably the clearance is substantially constant, the retainer and retainer aperture including corresponding cranked portions whereby said clearance turns through a substantial angle, the cranked portions constituting the moisture stopping structure.

The cranked portion of the retainer and retainer aperture may be chamfered on a convex portion to increase the peripheral clearance, thereby tending to eliminate surface tension effects.

In another embodiment the peripheral clearance is substantially constant, one of the retainer and retainer aperture including a recess whereby said peripheral clearance is increased, the recess constituting the moisture stopping structure. Again the increased clearance tends to eliminate surface tension effects.

In a preferred embodiment the assembly has two terminal apertures and a retainer aperture extending through one of the terminal apertures to the other terminal aperture, the moisture stopping structure being located between said terminal apertures. A drain aperture may extend between the terminal apertures and cross the retainer aperture, the moisture stopping structure being situated in said drain aperture. This has the advantage that progress of moisture is not merely stopped; the moisture is released directly into a drain channel of the connector, and conducted to the exterior.

According to another aspect the invention provides a connector assembly comprising mutually engageable connector housings, one of said housings having a-rib protruding in the engagement direction, and the other of said housings having a closely fitting receiving member adapted to receive the rib. In such an arrangement the rib and receiving member define a relatively narrow clearance substantially perpendicular to the mating faces of the housings and which serves to increase the distance from the outside of the housings to the electrical terminals within the housings. This increased moisture path is an effective barrier to moisture ingress.

Preferably the rib is peripheral and continuous, and the receiving member comprises a continuous groove. Such an arrangement provides a moisture path length which is double the projection of the rib. The clearance/path length ratio preferably exceeds 50:1 and may be of the order of 100:1. An enlarged recess may be provided at the base of the groove, thereby to eliminate surface tension effects.

According to a third aspect the invention provides a connector assembly comprising connector housings mutually engageable along a connection axis, one of said housings having a projecting hood and the other of said housings having a rim protruding in the direction of said axis in the fully engaged condition, said hood being adapted to cover said rim over a portion of the periphery thereof when the housings are engaged in use. Such a hood prevents moisture directly reaching the interface between the connector housings, and thereby provides protection against moisture ingress.

In a preferred embodiment the hood is stepped outwardly from the outer face of the respective housing thereby providing a ledge to prevent moisture on the outer face of the housing reaching the edge of the hood. Such a ledge is effective in reducing the amount of moisture on the hood, and thereby reducing the likelihood of moisture ingress.

Preferably the hood extends partially around the respective housing; in a preferred embodiment the housing is rectangular and the hood extends on three sides thereof. In the preferred embodiment the female connector is inserted almost fully inside the male connector so as to give good resistance to moisture penetration. In such a case the hood covers the top and partially the sides of the exposed end of the female connector, the uncovered side portions being able to be gripped by the hand to enable the connector housings to be separated. A hood may also be provided at the rear one or both housings to provide protection against moisture ingress, typically through the usual wire channels.

In a preferred embodiment drain apertures of respective housings have tapered mouths for mutual sealing engagement; the mouths preferably taper in the same sense but at a different angle to ensure line contact, most preferably adjacent the inner mouth periphery. Respective terminal apertures may in the same manner also have tapered openings for mutual sealing engagement.

BRIEF DESCRIPTION OF DRAWINGS

Other features of the invention will be apparent from the following description of several preferred embodiments, shown by way of example only in the accompanying drawings in which.

DESCRIPTION OF PREFERRED EMBODIMENTS

Figure 1:
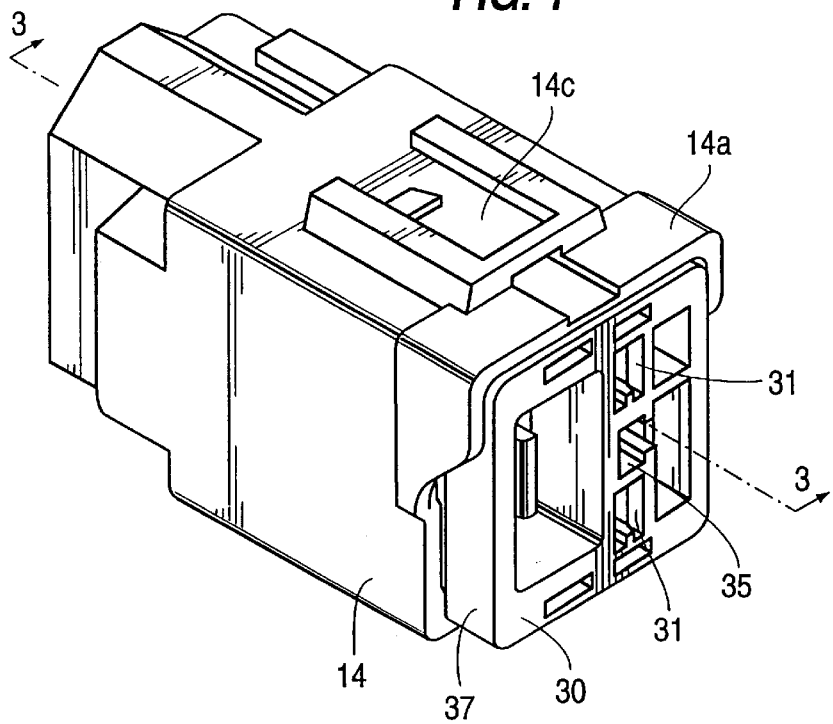
FIG. 1 is a diagonal view showing the fitted state of an embodiment of the present invention.

An embodiment of the present invention is explained hereinbelow, with reference to FIGS. 1 to 8.

A connector comprises a pair of male and female connector housings 10 and 30, mutually attachable and separable; terminal fittings 12 and 32 that are attached to the connector housings 10 and 30; retainers 20 and 40 that support the terminal fittings 12 and 32 in the connector housings 10 and 30; and a simplified water-proofing structure, to be described.

The male connector housing 10 has two terminal fitting housing chambers 11, one above the other. The male terminal fitting 12 is inserted from the open posterior end of the chamber 11 and is maintained in a specified position by means of a lance 13 and a retainer 20, to be described. A male tab 12A of the male terminal fitting 12 protrudes out from the open anterior end of the terminal fitting housing chamber 11 and continues into a hood member 14 projecting in an angular tubular manner from the anterior end-face periphery of the male connector housing 10.

A moisture removing hole 15 that extends in an anterior-posterior direction is formed in the space between the two terminal fitting housing chambers 11. This moisture removing hole 15 opens out in the posterior end face of the male connector housing 10, and connects with a moisture removing hole 35 of the female connector housing 30, to be described later.

A retainer insertion hole 16 is formed on the male connector housing 10, and opens out to the lower face of the male connector housing 10 and vertically passes through the lower male terminal housing chamber 11 and the moisture removing hole 15, opening out to the lower face of the upper male terminal fitting housing chamber 11. The retainer 20 can be inserted in the retainer insertion hole 16 in a temporary stopping position which allows the insertion of the male terminal fitting 12, and in a full stopping position which maintains the male terminal fitting 12 in an unremovable position. The retainer 20 has a male terminal fitting through hole 21 that connects with the lower male terminal fitting housing chamber 11, and a moisture removing through hole 22 that connects with the moisture removing hole 15. The upper end of the retainer 20 protrudes into the upper male terminal fitting housing chamber 11.

The female connector housing 30 fits within the hood member 14 of the male connector housing 10 as illustrated in FIG. 1. Two female terminal fitting housing chambers 31, one above the other, are formed in the female connector housing 30. The female terminal fitting 32 is inserted from the open posterior end of the female terminal fitting housing chamber 31 and is maintained in a specified position by means of a lance 33 and a retainer 40, to be described later. The female terminal fitting 32 receives the tab 12A from the anterior open end of the female terminal fitting housing chamber 31.

In the female connector housing 30, a moisture removing hole 35 that extends in an anterior-posterior direction is formed in the space between the two female terminal fitting housing chambers 31. This moisture removing hole 35 opens out in the posterior end face of the female connector housing 30, and connects with the moisture removing hole 15 of the male connector housing 10.

Furthermore, a retainer insertion hole 36 is formed on the female connector housing 30, and opens out to the upper face of the female connector housing 30 and vertically passes through the upper female terminal housing chamber 31 and the moisture removing hole 35 as viewed, opening out to the upper wall face of the lower female terminal fitting housing chamber 31. The retainer 40 can be attached to the retainer insertion hole 36 in a temporary stopping position which allows the insertion of the female terminal fitting 32, and in a full stopping position which maintains the female terminal fitting 32 in an unremovable state. The retainer 40 has a female terminal fitting through hole 41 that connects with the upper female terminal fitting housing chamber 31, and a moisture removing through hole 42 that connects with the moisture removing hole 35. The lower end of the retainer 40 protrudes into the lower female terminal fitting housing chamber 31. Note that in FIG. 3 electrical terminals are illustrated in the respective upper chambers but not in the lower chambers.

The hood member 14 has a protruding hood 14*a* that in use extends over the mating connector (see FIG. 1). The hood has a step 14*b* at the anterior edge and extends around three sides of the housing as illustrated. The upper face of the male connector has a clip structure 14*c* to enable the housing to be attached in a specific orientation. A generally 'U' shaped rear hood 14*d* is provided at the other end of the connector housing.

Next, a water-proofing structure provided in the connector of the present embodiment is described.

A water-proofing structure is used in the small space formed between the retainers 20 and 40 and the retainer insertion holes 16 and 36, and in the space formed between meeting faces 18 and 38 (the anterior end faces that face each other during fitting) of the male and female connector housings 10 and 30.

The inner wall face of the anterior side (the right side in FIGS. 3 and 4) of the male retainer insertion hole 16 is formed so as to be straight in the up-down direction, as viewed. However, the posterior inner wall face is formed so that at the height where the water removing hole 15 is formed, the upper part of the inner wall face bends so that it is positioned more towards the anterior side than the lower part of the inner wall face, thereby forming a crank shape. In this way, a moisture stopping member 19 is formed. The bent portion of this moisture stopping member 19 has right angled corners when seen from the side and serves to obstruct movement of moisture in the clearance.

The anterior wall face of the retainer 20 is cut away into a C-shaped recess at a height corresponding to the height of the upper face wall of the water removing through hole 22, thereby forming a moisture stopping member 23. The edge of the open end of this moisture stopping member 23 is angled at 45° and the two bent portions at the upper and lower ends of the inner end of the water stopping member 23 have right-angled corners. Moreover, the posterior wall face of the retainer 20 is cut away at a location that is slightly above the height corresponding to the location of the moisture removing through hole 22, thereby forming a crank-shaped water stopping member 24 that fits with the moisture stopping member 19 of the retainer insertion hole 16. Among the two bent portions of the-moisture stopping member 24 of the retainer 20, the anterior bent portion is angled at a right angle, while the posterior bent portion has a face angled at 45° (see FIG. 3).

The inner wall face of the anterior side (the left side in FIGS. 3 and 4) of the female retainer insertion hole 36 is formed in a similar manner to that of the male connector described above.

Similar moisture stopping structures 39,43,44 are formed, the members 43 and 44 having 45° angles as illustrated.

The meeting face of the female connector housing 30 has a rectangular shaped rib 45 (referred to hereinafter as a peripheral rib) formed along the external periphery thereof and protruding in an anterior direction. Corresponding to this, the meeting face 18 of the male connector housing 10 has a receiving member 25 formed in a rectangular groove shape so as to receive the peripheral rib 45. Since dimensional tolerance is taken into consideration, a very small clearance is formed between this peripheral rib 45 and the receiving member 25. The length of this clearance is however relatively long which tends to eliminate surface tension and capillary effects so that moisture does not pass into the connector.

Furthermore, the meeting face 38 of the female connector housing 30 has a pair of ribs 46 (referred to hereinafter as connecting ribs). These connecting ribs 46 are plate shaped and protrude anteriorly along planes aligned vertically and corresponding to the upper and lower wall faces respectively of the moisture removing hole 35. Both the side edges of these connecting ribs 46 connect with the inner face of the peripheral rib 45. Corresponding to this, the meeting face 18 of the male connector housing 10 has receiving members 26 formed by cutting away the upper and lower edges of the open end of the moisture removing hole 15, the receiving members 26 receiving the connecting ribs 46. The moisture removing holes 15 and 35 of the connector housings 10 and 30 are connected by means of the connecting ribs 46 and the receiving members 26.

Figure 7:
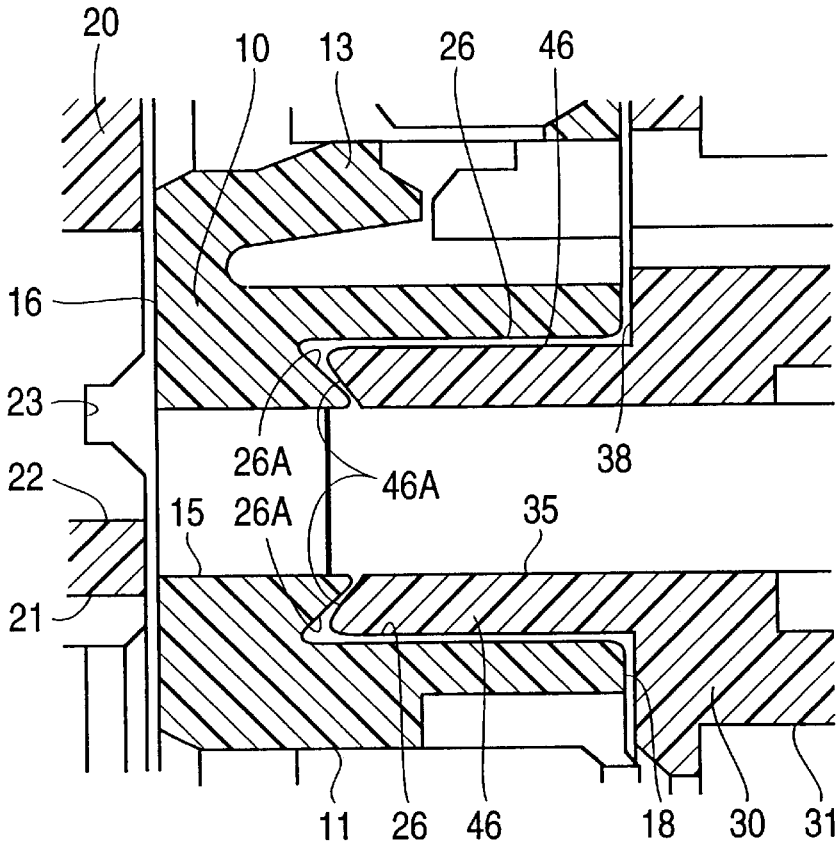
FIG. 7 is a partially enlarged cross-sectional view showing a moisture-proofing structure in a connecting portion of a moisture removing hole.
Figure 8:
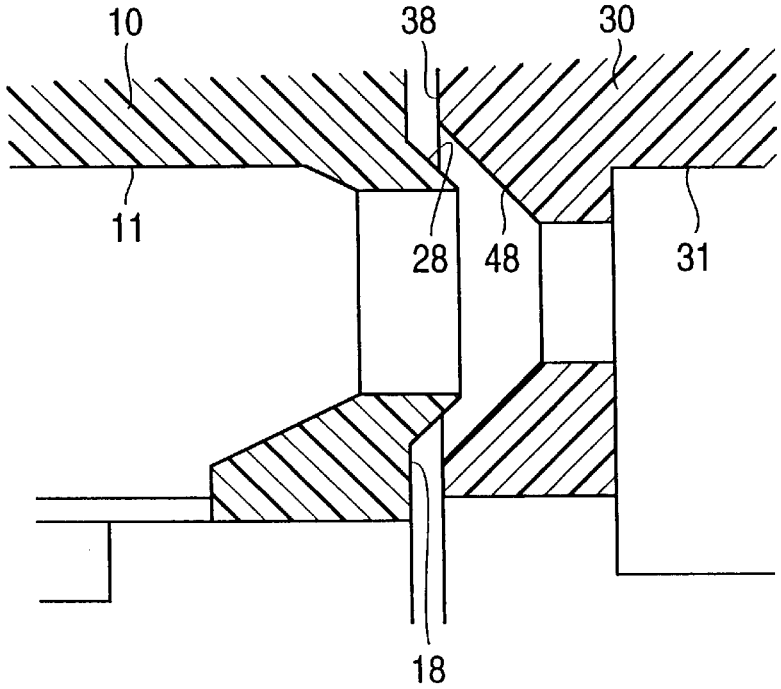
FIG. 8 is a partially enlarged cross-sectional view showing a water-proofing structure at the open end of a terminal fitting housing chamber.

The anterior ends of the upper and lower connecting ribs 46 have water-tight supporting members 46A that taper so as to spread in the outward direction; and the inner ends of the receiving members 26 have water-tight supporting members 26A that taper off in an anterior direction (see FIG. 7). The angle of tapering of the water-tight supporting member 46A of the connecting rib 46 (that is, the angle with respect to the fitting direction of the connector housings) is set to be less than that of the water-tight supporting member 26A of the receiving member 26. The water-tight supporting members 46A make tight linear contact with the supporting members 26A; as a result, leakage of moisture in the connecting region of the water removing holes 15 and 35 is prevented.

Figure 2:
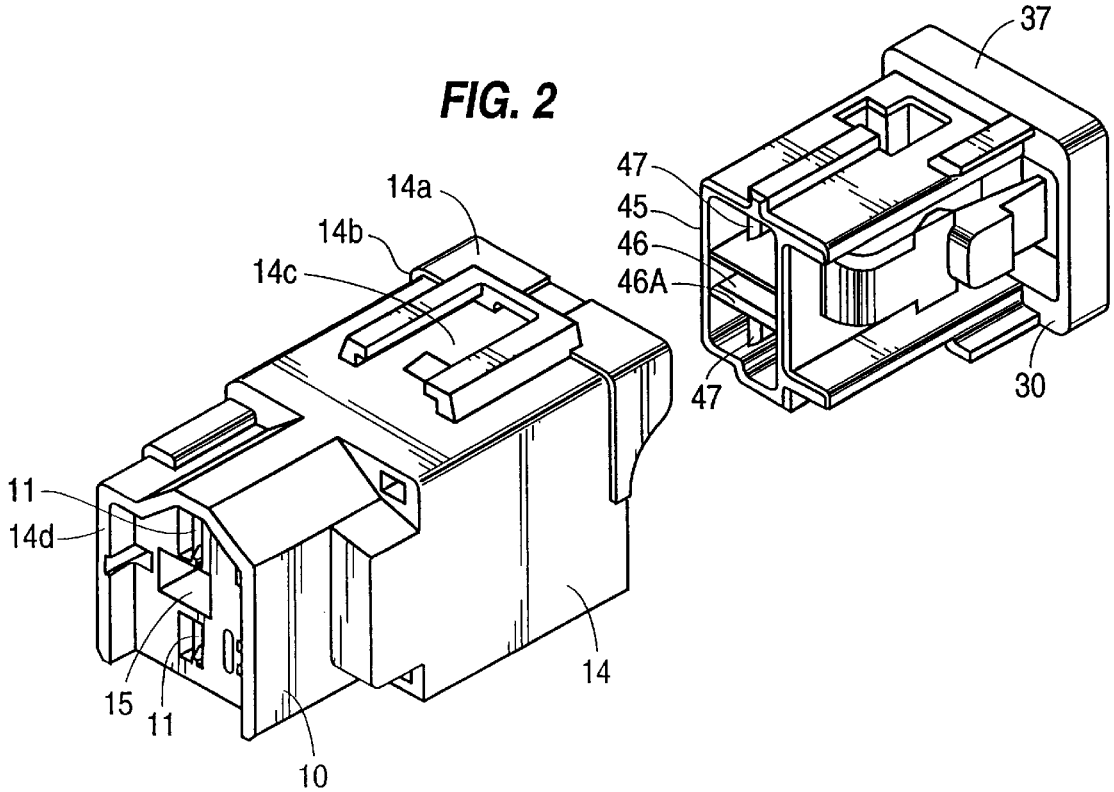
FIG. 2 is a diagonal view of the separated state of FIG. 1.
Figure 3:
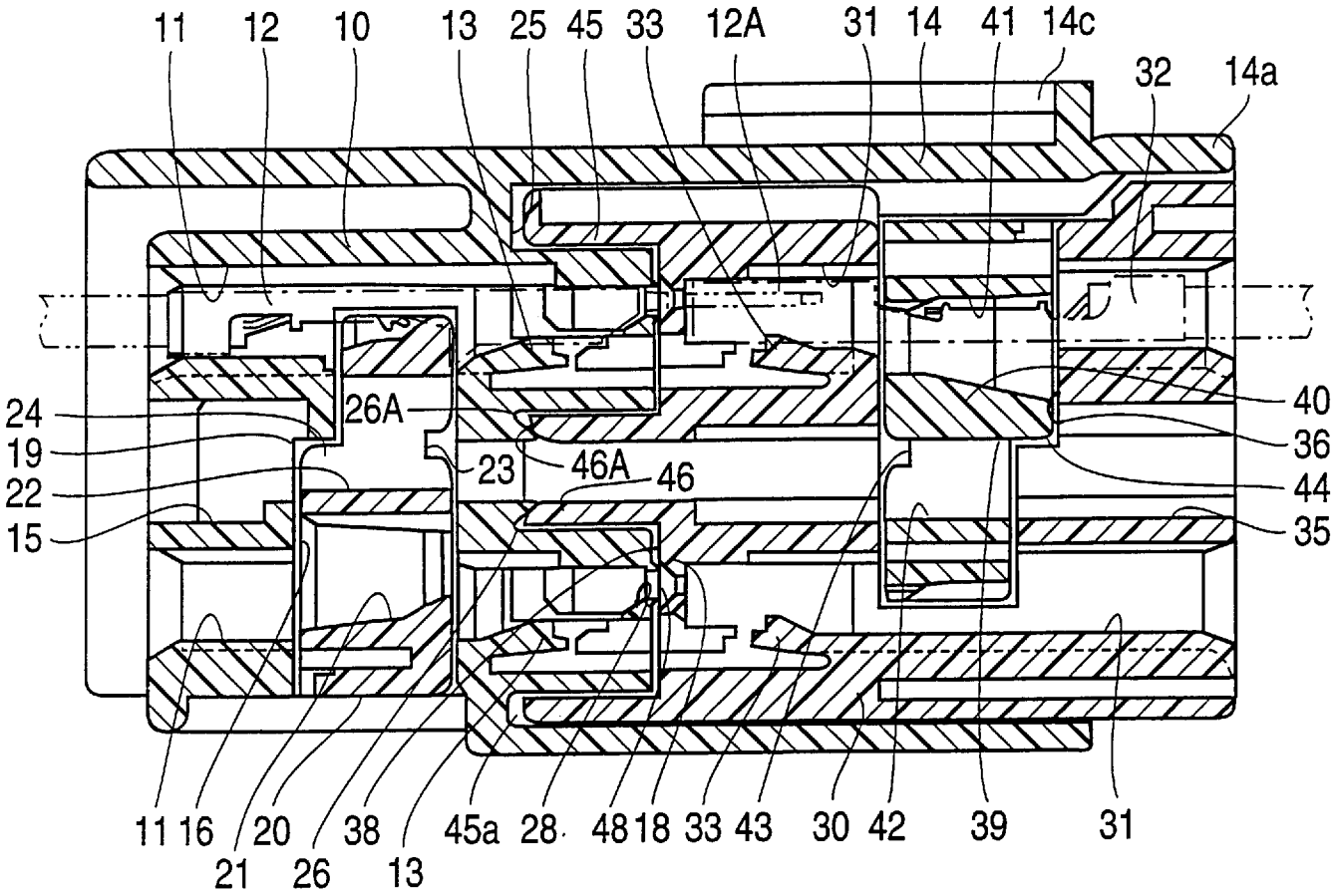
FIG. 3 is a cross-section view of the fitted state of FIG. 1.
Figure 4:
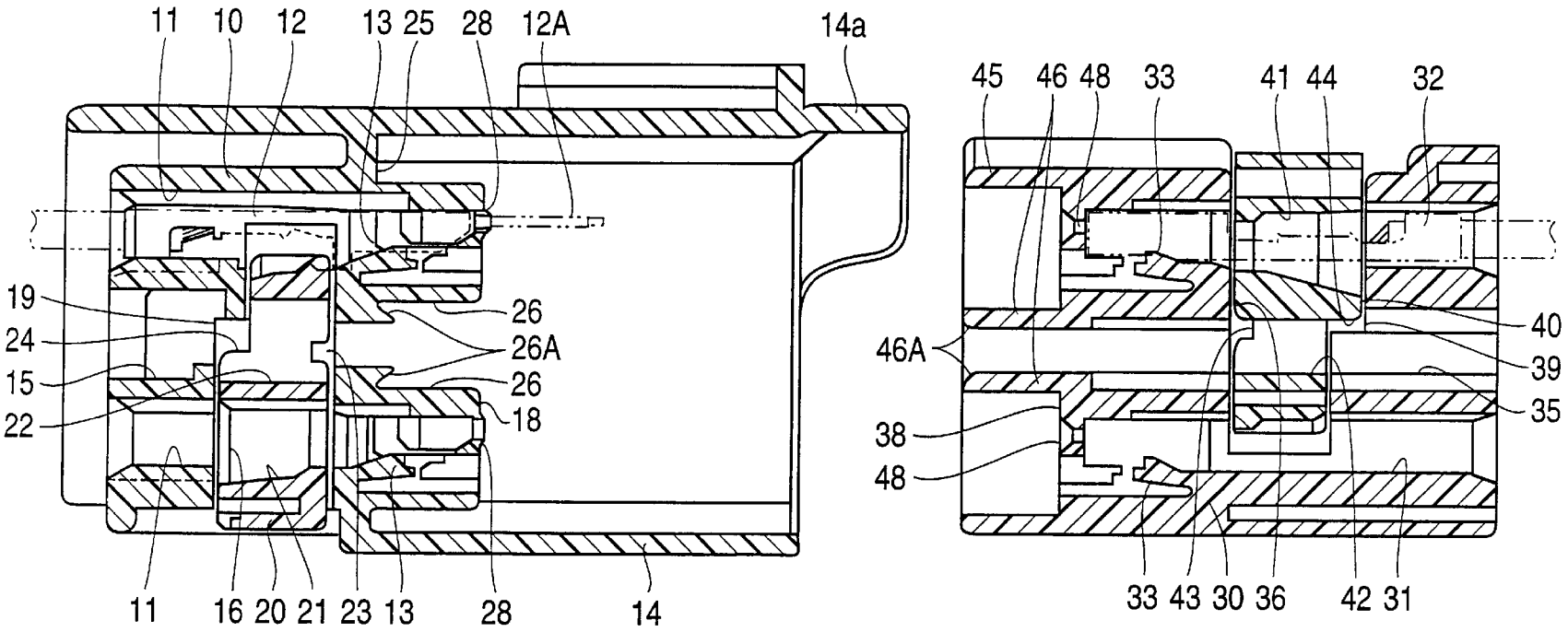
FIG. 4 is a cross-sectional view of the separated state of FIG. 1.
Figure 5:
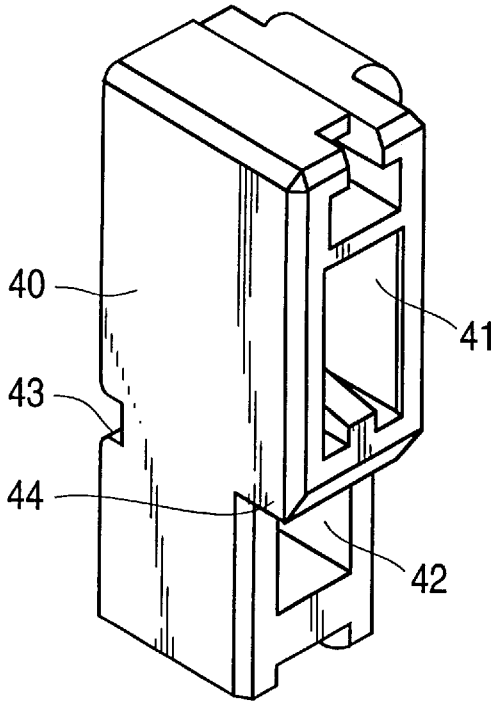
FIG. 5 is a diagonal view of a retainer attached to a female connector housing.
Figure 6:
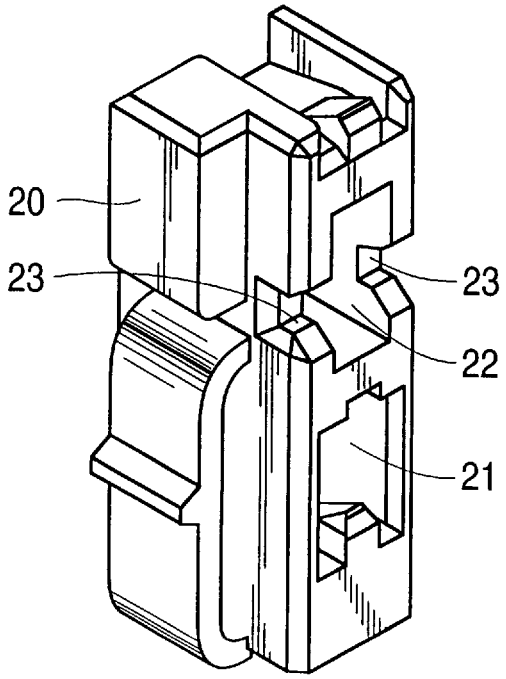
FIG. 6 is a diagonal view of a retainer attached to a male connector housing.

The upper and lower sides of the water removing hole 35 has short-circuiting and short-circuit releasing members 47 that are formed so as to protrude from the meeting face 38 of the female connector housing 30 (see FIG. 2). These short-circuiting and short-circuit releasing members 47 are respectively insertable into the male connectors housings 10 and serve to short-circuit the male terminal fittings 12 and to release their short-circuiting. The short-circuiting and short-circuit releasing members 47 are formed so as to be housed in the two spaces constituted by the peripheral ribs 45 and the connecting ribs 46. Accordingly, other parts are prevented from colliding with the short-circuiting and short-circuit releasing members 47.

The meeting face 18 of the male connector housing 10 has a terminal fitting rib 28 formed along the mouth edge of the open end of the male terminal fitting housing chamber 11. As shown in the enlarged view in FIG. 8, the periphery of the outer side of the terminal fitting rib 28 is formed so as to taper. Corresponding to this, the meeting face 38 of the female connector housing 30 has an inwardly tapering receiving member 48, the tapering taking place along the mouth edge of the open end of the female terminal fitting housing chamber 31. The terminal fitting rib 28 enters into the receiving member 48.

The hood 14*a* covers the meeting face of the housings and serves to obstruct passage of moisture therein.

Figure 9:
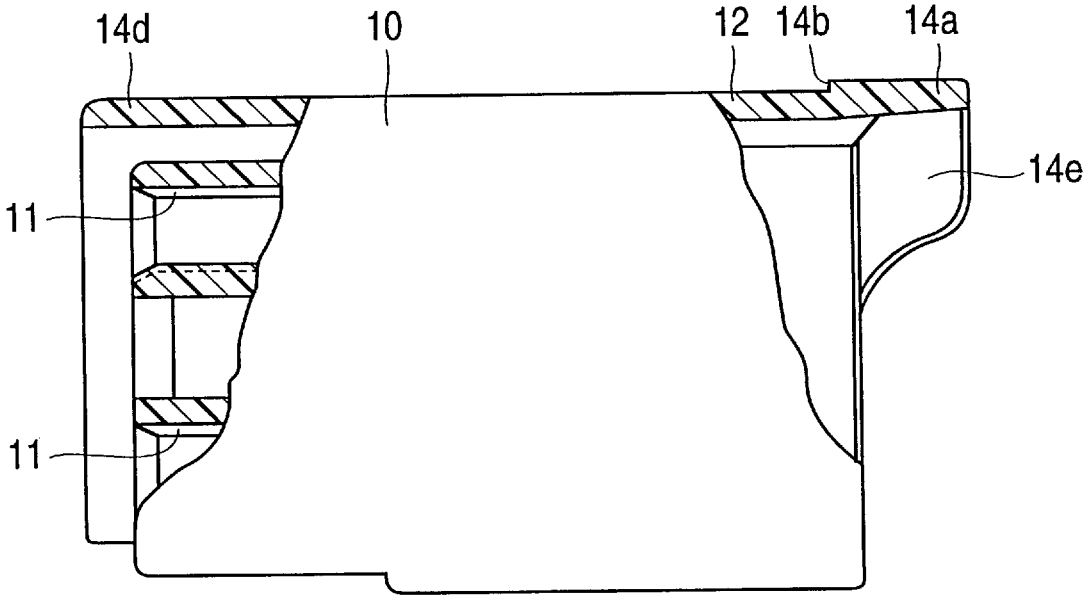
FIG. 9 is an axial cross-section through a connector having a hood.
Figure 10:
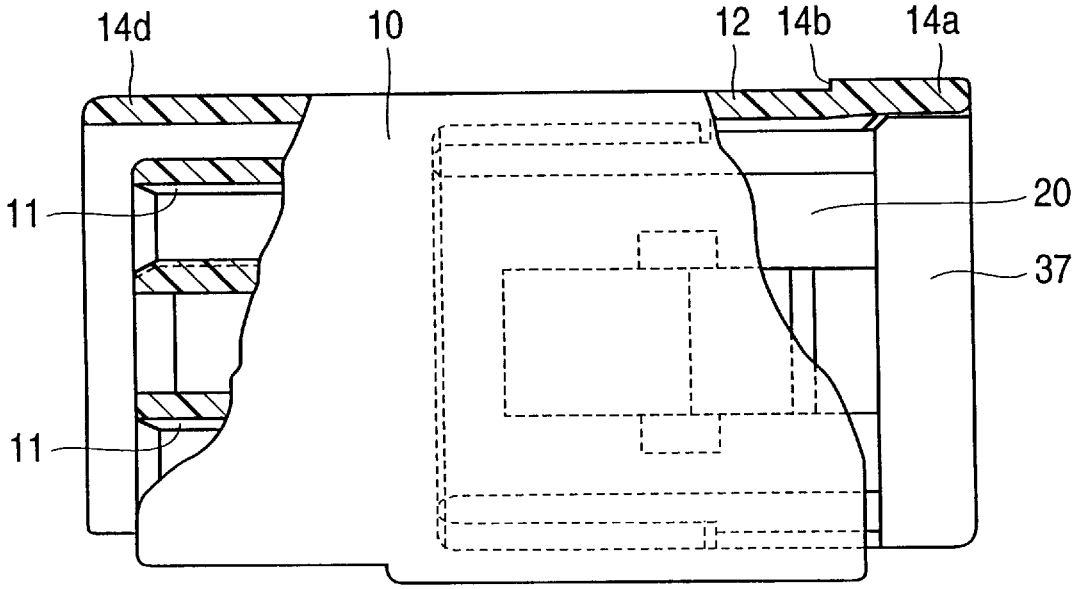
FIG. 10 is an axial cross-section showing the connector of FIG. 1 with a mating connector inserted therein.

Moreover, the step 14*b* provides a ledge which prevents moisture on the upper surface of the connector from running towards the edge of the hood; this arrangement minimizes the amount of moisture which may reach the edge of the hood. As illustrated the ledge is substantially perpendicular to the upper surface of the housing. A rear hood 14*d* may be provided (FIG. 9) to shield the usual apertures at the other end of the connector housing.

Next, the operation of the present embodiment is explained. The terminal fittings 12 and 32 are inserted into the connector housings 10 and 30, and the retainers 20 and 40 are fitted. In this state, wherein the connector housings 10 and 30 are fitted together, the following simplified water-proofing function is effected.

The lower face of the male connector housing 10 has a space opening out between the retainer 20 and the retainer insertion hole 16. If moisture accumulates on to the open end member, there is a possibility of moisture entering the space due to surface tension. However, the moisture that does enter the space is prevented from spreading by the crank shaped moisture stopping members 19 and 24 and the C-shaped moisture stopping member 23, these being formed along the path of entry of the water. That is, in the crank shaped moisture stopping members 19 and 24, since the distance between the mutually facing faces of the retainer 20 and the retainer insertion hole 16 is maintained over a long distance, it becomes difficult for the moisture to reach the inner end. In the C-shaped moisture stopping member 23, the space between the mutually facing faces of the retainer 20 and the retainer insertion hole 16 is wide, thereby destroying the surface tension effect. As a result, moisture is prevented from progressing any further and a simple water-proofing effect is produced, thereby preventing moisture from spreading towards the inner side of the moisture stopping members 19, 23 and 24.

Moreover, even if moisture, which has entered the male terminal fitting housing chamber 11 from the open end of the posterior end face of the male connector housing 10, enters the space between the retainer insertion hole 16 and the retainer 20, as in the above case, spreading of moisture towards the inner side is prevented by the water stopping members 19, 23 and 24.

Further, since the moisture stopping members 19, 23 and 24 are formed so as to be located over the moisture removing channel 15, even if excess moisture overflows in the water stopping members 19, 23 and 24, this moisture does not proceed towards the inner end, but rather flows into the moisture removing hole 15 and is released into the exterior.

As in the case of the male connector housing 10, in the female connector housing 30 as well, the crank shaped moisture stopping members 39 and 44 and the C-shaped water stopping member 43 are formed along the path of the flow of water in the space between the retainer 40 and the retainer insertion hole 36, resulting in the prevention of spreading of water that enters the space. Even if excess moisture overflows in the moisture stopping members 39, 43 and 44, this moisture does not proceed towards the inner end, but rather flows into the moisture removing channel 35 and is released into the exterior. Moreover, since the female connector housing 30 is housed in the hood member 14 and the open end of the retainer insertion hole 36 is hidden from the exterior, it is difficult for leakage of moisture to take place from the open end of the retainer insertion hole 36.

Since the ribs 45 and 46 and the receiving members 25 and 26 are formed between the meeting faces 18 and 38 of the male and female connector housings 10 and 30, the space formed by the facing faces of the connector housings 10 and 30 extends over a long length. As a result, even if moisture enters through the space between the outer circumference of the female connector housing 30 and the inner circumference of the hood member 14, it is possible to stop the spread of moisture in the region of the peripheral rib 45. The enlarged inner clearance 45*a* acts in the manner of recess 23 to break surface tension and prevent creeping of moisture by capillary effects. If moisture enters the space between the protruding faces 18 and 38 by passing over the peripheral rib 45, it is possible to stop the spread of moisture in the clearance or at the connecting rib 46.

In particular, since the water-tight supporting members 46A and 26A are formed on the connecting rib 46 and on the receiving member 26 provided on the connecting portion of the moisture removing holes 15 and 35, there is no leakage of water in the water removing holes 15 and 35 into the space between the meeting faces 18 and 38. Moreover, since the terminal fitting rib 28 is provided on the open end portion of the male terminal fitting housing chamber 11, it is difficult for moisture to enter the male terminal fitting housing chamber 11 from the space between the meeting faces 18 and 38.

As described above, in the present embodiment, by providing moisture stopping members 19, 23, 24, 39, 43 and 44 in the space between the retainers 20 and 40 and the retainer insertion holes 16 and 36, spread of moisture in that space is prevented. Accordingly, a water-proofing effect is achieved. In particular, since the moisture stopping members 19, 23, 24, 39, 43 and 44 are located over the moisture removing holes 15 and 35 so as to allow moisture to flow to the exterior of the connector housings, a superior water-proofing effect is achieved. The moisture stopping structures effectively break the capillary path and release moisture into the central channel 15,35; moisture is otherwise retained in the clearance by capillary action. Further, since the moisture stopping members 19, 23, 24, 39, 43 and 44 and the moisture removing holes 15 and 35 are located between the upper and lower terminal fitting housing chambers 11 and 31, the transference of moisture from the terminal fitting housing chambers 11 and 31 located at one end of the terminal fitting housing chambers 11 and 31 located at the other end is also prevented.

The hood 14*a* and ledge 14*b* further reduce the possibility of moisture reaching the space between the connectors and thus interfering with electrical conductivity between the respective terminals; the ledge effectively directs moisture to the rear or over the side of the housing.

The present invention is not limited to the embodiments described above with the aid of figures. For example, the possibilities described below also lie within the technical range of the present invention. Moreover, the present invention may be embodied in various ways other than those described below without deviating from the scope thereof.

(1) Although in the above embodiment the anterior moisture stopping member has been formed in a crank shape, this crank shaped moisture stopping member may equally be provided at the anterior and the posterior sides, or may be provided only at the posterior side.

(2) Although in the embodiment described above the anterior moisture stopping member is formed so as to be C-shaped, the C-shaped moisture stopping member can be provided both at the anterior and posterior sides, or may be provided only at the posterior side.

(3) Although in the embodiment described above the C-shaped moisture stopping member has been provided only on the retainer side, it can equally be provided on the retainer insertion hole side.

(4) Although in the embodiment described above the water stopping member is provided between the terminal insertion housing chambers, the moisture stopping member can equally be provided between the external face of the connector housing and the terminal fitting housing chamber.

(5) Although in the embodiment described above the moisture removing hole is provided between the terminal fitting housing chambers, the moisture removing hole can equally be provided between the external face of the connector housing and the terminal fitting housing chamber.

(6) Although in the embodiment described above the moisture removing hole has been provided, the configuration may equally be such that no moisture removing hole is provided.

(7) Although a stepped hood has been described to restrict flow of moisture to the edge of the hood, the step can be omitted; the side walls to the projecting hood are optional. The projecting hood at the posterior end is optional. Furthermore a posterior hood can be provided on both male and female connector.

(8) Although in the above embodiment the receiving member is formed on the male connector housing and the rib member is formed on the female connector housing, it may equally be arranged that the male connector housing has the rib and the female connector housing has the receiving member.

(9) Although in the embodiment described above the ribs are provided on the periphery of the facing face and the connecting portion of the water removing hole, the ribs may equally be provided so that they surround the terminal fitting housing chambers.

(10) Although in the embodiment described above the moisture-proofing maintaining member is provided in a tapered shape that is diagonal with respect to the fitting direction, it may equally be arranged so that an elastic bending member is formed in a unified manner on either the rib member or the receiving member or both, waterproofing being maintained due to the close fit achieved because of the elasticity of the elastic bending member. In such a case, dimensional tolerance is absorbed and, accordingly, a high degree of waterproofing is achieved.

(11) Although in the embodiment described above a waterproofing maintaining member is formed on the connecting rib of the water removing hole and its receiving member, it may equally be arranged that the water-proofing maintaining member is not provided. In this case as well, since a long length is maintained between the facing faces, water overflowing from the water removing hole does not proceed to the facing face.

(12) The various moisture stopping measures disclosed herein may be used in conjunction or separately depending on the connector to which they are applied, and may be applied to both male and female connectors.

We claim:

1. An electrical connector comprising a housing having two terminal apertures and a retainer aperture extending through one of said terminal apertures to the other terminal aperture so as to be connecting therewith, each terminal aperture receiving in use an electrical terminal and the housing further comprising a retainer insertable in the retainer aperture to retain the electrical terminals in the housing, the retainer having a small peripheral clearance in the retainer aperture sufficient to form a transfer passage of moisture by surface tension effects, one of said retainer and retainer aperture including integral moisture stopping structure in said passage between said terminal apertures for substantially preventing transfer of moisture inwardly thereof, and a drain aperture extending between said terminal apertures and crossing said retainer aperture, the moisture stopping structure being situated in use in said drain aperture.

2. A connector according to claim 1 wherein said peripheral clearance is substantially constant, the retainer and retainer aperture include corresponding cranked portions whereby said clearance turns through a substantial angle, and the cranked portions constitute said moisture stopping structure.

3. A connector according to claim 2 wherein the cranked portion of one of said retainer and retainer aperture is chamfered to increase said peripheral clearance.

4. A connector according to claim 1 wherein said peripheral clearance is substantially constant, one of the retainer and retainer aperture includes a recess whereby said peripheral clearance is increased, and the recess constitutes said moisture stopping structure.

5. A connector according to claim 1 wherein said terminal apertures are parallel, and said drain aperture is parallel with said terminal apertures and co-planar therewith.

6. A connector according to claim 5 wherein said retainer aperture is orthogonal to said terminal apertures.

7. A connector according to claim 1 wherein said retainer includes a through hole aligned in use with said drain aperture.

8. A connector assembly comprising a pair of connectors according to claim 1, the connectors being adapted to be coupled and having corresponding male and female formations.

9. An assembly according to claim 8 wherein each housing of the assembly includes a drain aperture extending between respective terminal, apertures the drain apertures of each housing being co-axial.

10. An assembly according to claim 9 wherein said drain apertures have respective tapered mouths for mutual sealing engagement with each other.

11. An assembly according to claim 10 wherein the mouths are tapered in the same direction and at a different angle so as to ensure line contact.

12. An assembly according to claim 11 wherein said line contact is adjacent the inner periphery of said mouths.

13. An assembly according to claim 8 wherein respective terminal apertures are aligned for mutual contact on connection of the housings, the terminal apertures having tapered openings for mutual sealing engagement.

14. An assembly according to claim 8 further including a peripheral rib on one of said housings and a peripheral groove on the other of said housings and adapted to receive said rib, the rib and groove defining a clearance sufficiently narrow and long to prevent moisture transmission by capillary action.

15. An assembly according to claim 14 wherein said clearance extends for substantially twice the length of the projection of said rib.

16. A connector assembly comprising a pair of connector housings mutually engageable along a connection axis, each said housing having terminal apertures adapted to receive mutually connecting electrical terminals, one of said housings having a forward end adapted to face the other housing in a fully engaged condition of the connector housings, and a rim at a rearward end of the housing, said other housing having a front end, a rear end with open ends of said terminal apertures, a first hood projecting forwardly at the front end to receive and shield the other housing therein and cover said rim over at least a portion of the periphery thereof in the fully engaged condition, and a second hood projecting rearwardly beyond said open ends of said terminal apertures to shield the terminal apertures at the rear end.

17. An assembly according to claim 16 wherein said first hood has a substantially 'U' shaped distal end portion having a mid portion to cover one side of said rim and side portions adapted to cover part of adjacent sides of said rim.

18. An assembly according to claim 16 wherein an outward step is defined between the other housing and said hood, said step defining an obstruction to moisture passing from the outer surface of the other housing to the outer surface of said hood.

19. An assembly according to claim 16 wherein each housing of the assembly includes a drain aperture extending between respective terminal apertures, the drain apertures of each housing being co-axial.

20. An assembly according to claim 19 wherein said drain apertures have respective tapered mouths for mutual sealing engagement with each other.

21. An assembly according to claim 20 wherein the mouths are tapered in the same direction and at a different angle so as to ensure line contact.

22. An assembly according to claim 21 wherein said line contact is adjacent the inner periphery of said mouths.

23. An assembly according to claim 16 wherein respective terminal apertures are aligned for mutual contact on connection of the housings, the terminal apertures having tapered openings for mutual sealing engagement.

24. An assembly according to claim 23 further including a peripheral rib on one of said housings and a peripheral groove on the other of said housings and adapted to receive said rib, the rib and groove defining a clearance sufficiently narrow and long to prevent moisture transmission by capillary action.

25. An assembly according to claim 24 wherein said clearance extends for substantially twice the length of the projection of said rib.

* * * * *